US008579046B2

(12) United States Patent
Crawford et al.

(10) Patent No.: US 8,579,046 B2
(45) Date of Patent: Nov. 12, 2013

(54) PRESSURE COMPENSATOR FOR DRILL BIT

(75) Inventors: Michael Burl Crawford, Montgomery, TX (US); Pele Jason Nunley, Mansfield, TX (US)

(73) Assignee: Burintekh USA, LLC, Fort Worth, TX (US)

( * ) Notice: Subject to any disclaimer, the term of this patent is extended or adjusted under 35 U.S.C. 154(b) by 411 days.

(21) Appl. No.: 12/740,390

(22) PCT Filed: Sep. 13, 2007

(86) PCT No.: PCT/US2007/078432
§ 371 (c)(1),
(2), (4) Date: Apr. 29, 2010

(87) PCT Pub. No.: WO2009/035455
PCT Pub. Date: Mar. 19, 2009

(65) Prior Publication Data
US 2010/0230170 A1 Sep. 16, 2010

(51) Int. Cl.
*E21B 10/24* (2006.01)

(52) U.S. Cl.
USPC ..... 175/227

(58) Field of Classification Search
USPC ..... 175/227–229
See application file for complete search history.

(56) References Cited

U.S. PATENT DOCUMENTS 3,917,028 A * 11/1975 Garner ..... 184/6.14
4,388,984 A * 6/1983 Oelke ..... 184/54
4,593,775 A * 6/1986 Chaney et al. ..... 175/228
4,665,946 A 5/1987 Hulsey
4,865,136 A 9/1989 White
5,072,795 A * 12/1991 Delgado et al. ..... 175/228
6,202,766 B1 3/2001 Shepherd
6,206,110 B1 3/2001 Slaughter, Jr. et al.
6,390,209 B2 5/2002 Saxman
2002/0104649 A1 8/2002 Allen
2003/0062200 A1* 4/2003 Blackman ..... 175/228
2008/0105467 A1* 5/2008 Yong et al. ..... 175/228

OTHER PUBLICATIONS

International Search Report and Written Opinion, PCT/US07/078432, May 19, 2008.

* cited by examiner

*Primary Examiner* — Jennifer H Gay
*Assistant Examiner* — Blake Michener
(74) *Attorney, Agent, or Firm* — Winstead PC

(57) ABSTRACT

A pressure compensation assembly for a drill bit having a cavity to receive the pressure compensation assembly, a mud port connected to the cavity, and a lubricant passageway connected to the cavity, is disclosed. The pressure compensation assembly includes a relief mechanism having a selected operating pressure. The pressure compensation assembly is movable from a first position to a second position within the cavity. The pressure compensation assembly may receive lubricant at a pressure exceeding the selected operating pressure to permit the flow of lubricant into the lubricant passageway while substantially preventing the release of lubricant into the mud port while in the first position. The pressure compensation assembly is operable to limit a pressure differential within the drill bit while in the second position.

21 Claims, 6 Drawing Sheets

PRESSURE COMPENSATOR FOR DRILL BIT

FIELD OF THE INVENTION

This invention relates in general to drill bits and, more particularly, to pressure compensation devices for drill bits.

BACKGROUND

Sealed bearing roller cone drill bits generally incorporate a compensating mechanism to limit the pressure differential between the lubricant sealed within the drill bit and the well bore fluid. The most common device is a flexible diaphragm separating the two fluids. The diaphragm responds to the conditions in the well to maintain a balanced pressure across the primary dynamic seals in the drill bit. These devices also typically compensate for volumetric changes of the lubricant which occur in the form of leakage or through thermal expansion.

Conventional compensators tend to bleed lubricant during lubrication of the drill bit due to the pressure at which lubricant is pumped into the drill bit, among other factors. As a result, a drill bit may have undesirable pressure variation and/or an improper amount of lubricant. Accordingly, it is a desire to provide an apparatus and method for providing a proper quantity of lubricant into a drill bit.

SUMMARY OF THE INVENTION

A apparatus and method for introducing lubricant into a drill bit is disclosed.

In one embodiment, a pressure compensation assembly for a drill bit having a cavity to receive the pressure compensation assembly, a mud port connected to the cavity, and a lubricant passageway connected to the cavity, is disclosed. The pressure compensation assembly includes a relief mechanism having a selected operating pressure. The pressure compensation assembly is movable from a first position to a second position within the cavity. The pressure compensation assembly may receive lubricant at a pressure exceeding the selected operating pressure to permit the flow of lubricant into the lubricant passageway while substantially preventing the release of lubricant into the mud port while in the first position. The pressure compensation assembly is operable to limit a pressure differential within the drill bit while in the second position.

In another embodiment, a drill bit having a pressure compensation assembly is disclosed. The pressure compensation assembly includes a relief mechanism having a selected operating pressure, wherein the pressure compensation assembly may receive lubrication at a pressure exceeding the selected operating pressure while substantially preventing the release of lubricant from the pressure compensation assembly.

In another embodiment, a method for lubricating a drill bit having a pressure compensation assembly comprising a relief mechanism having a selected operating pressure, is disclosed. The method includes the steps of providing lubricant to the drill bit at a selected pressure greater than the selected operating pressure; and substantially preventing lubricant from leaking from the pressure compensation assembly during the step of providing lubricant.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

Figure 1:
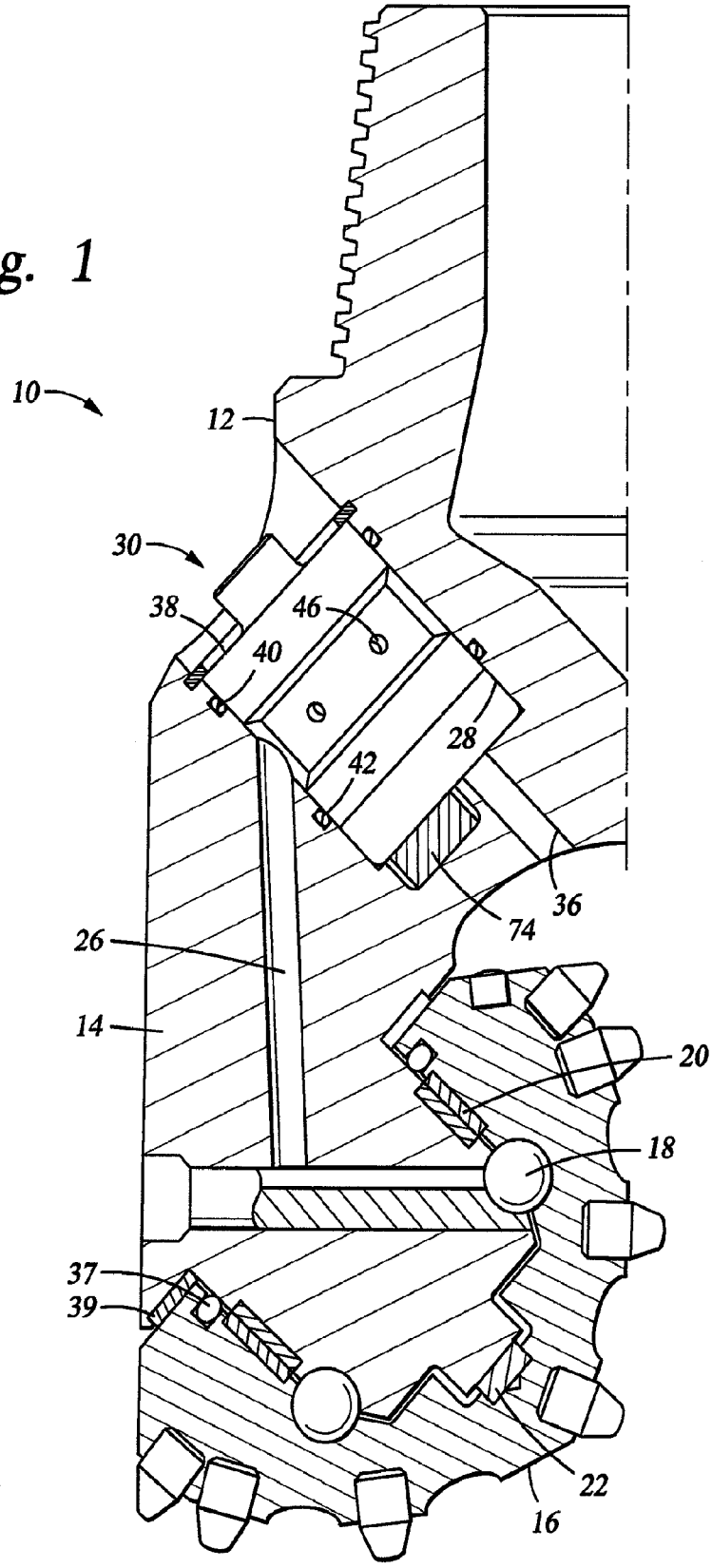
FIG. 1 is a partial, cross-sectional view of an arm of a roller cone drill bit having an embodiment of the pressure compensating apparatus.

Refer now to the drawings wherein depicted elements are not necessarily shown to scale and wherein like or similar elements are designated by the same reference numeral through the several views.

As used herein, the terms "up" and "down"; "upper" and "lower"; "uphole" and "downhole" and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 shows a partial cross sectional view of a section of a drill bit 10 suitable for an embodiment of the disclosed pressure compensator. Drill bit 10 includes a threaded body portion 12, a cone support arm 14, and a cutting cone 16 that is rotatably supported by the arm 14. The cone 16 is rotatably supported on the arm 14 by ball bearings 18, a bushing 20, and a thrust button 22. The cone 16 includes on its outer periphery several cutting elements 24. The cutting elements 24 engage the wall and bottom of a formation. The application of the rotation of and the application of weight to the bit 10 forms a well bore. Although FIG. 1 shows drill bit 10 as a roller cone drill bit, other types of earth boring bits may include embodiments of the disclosed pressure compensator.

Figure 2:
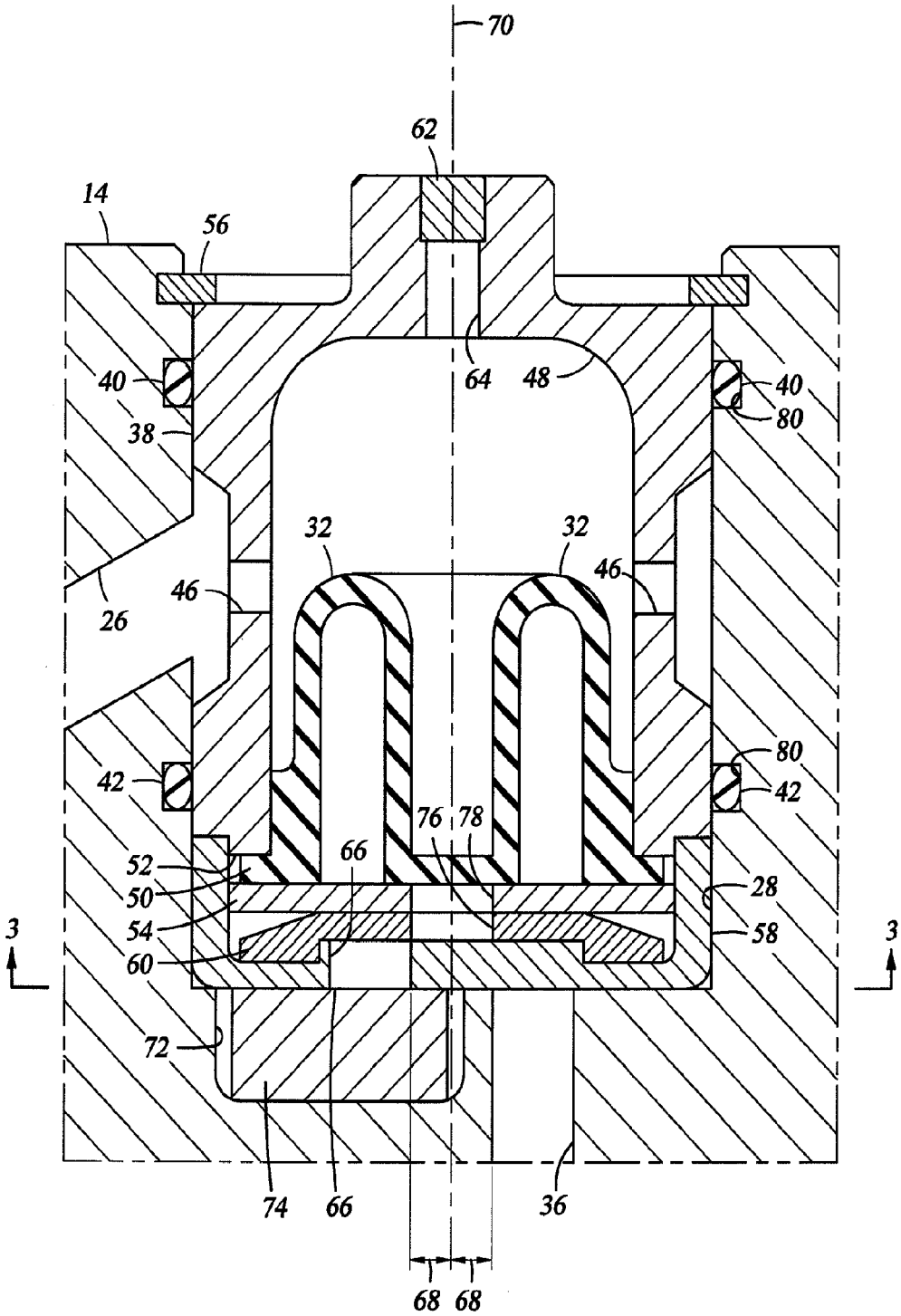
FIG. 2 is an enlarged partial cross-sectional view of a portion of FIG. 1, illustrating the pressure compensating apparatus in more detail in the fill position.

Lubricant is located within the cone 16 to lubricate the bearings 18, bushing 20, and thrust button 22 and extend the useful life of the bit 10. Arm 14 includes a lubricant passageway 26 and a cavity 28. As shown in FIGS. 1 and 2, the cavity 28 is configured to receive an embodiment of pressure compensating cartridge or assembly 30. Cavity 28 includes counterbore 72 positioned at the base of cavity 28 at an offset distance 68 from centerline 70 of cavity 28. Plug 74 is positioned within counterbore 72. Plug 74 may comprise a rubber plug or metal spring, for example, such that plug 74 may compress when pressure compensating assembly 30 is captured within cavity 28. Plug 74 may also absorb shock to protect the components of assembly 30.

Pressure compensating assembly 30 includes a flexible, cup-shaped diaphragm 32 exposed on one side to fluid pressure in the well bore (not shown) through a dome vent or mud port 36 formed in the arm 14 and on the other side to lubricant pressure. Mud port 36 intersects cavity 28 at the offset distance 68 from centerline 70, at a different point than counterbore 72. Bit seals 37 and 39 encircle the arm 14 within the cone 12 to retain the lubricant in the cone 16 and around the bushing 20, bearings 18, and thrust button 22. The seals 37 and/or 39 also prevent deleterious materials from entering into the cone 16 and causing premature bit failure due to bearing failure.

FIG. 2 is an enlarged partial cross-sectional view of a portion of FIG. 1, illustrating the embodiment of pressure compensating assembly 30 in more detail. Referring to FIGS. 1 and 2, pressure compensating assembly 30 includes reservoir cap or body 38. O-rings 40 and 42 encircle the exterior of body 38 to seal the lubricant from the downhole environment. Cone support arm 14 comprises annular O-ring grooves 80 to house and secure O-rings 40 and 42. Body 38 includes several radial perforations 46 to provide fluid communication between lubricant located in a hollow interior 48 of body 38 and the lubricant passageway 26. The interior 48 is exposed to the interior of diaphragm 32, which is also initially filled with lubricant. The diaphragm 32 has an annular lip or rim 50 that is disposed between lip 52 that is formed in the interior of the body 38 and piston disk 54 to retain diaphragm within interior 48

The body 38 has a fill passageway 64 extending axially through the body 38 and intersecting the interior 48. A removable plug 62 may be positioned into the fill passageway 64.

Pressure compensating assembly 30 includes snap ring 56 encircling the exterior of body 38 to capture the assembly 30 within cavity 28. Plug 74 may secure assembly 30 tightly against snap ring 56. Assembly 30 includes end cap 58 coupled to body 38 to contain the components of assembly 30 within interior 48. End cap 58 includes an offset end cap hole 66 positioned at a selected offset distance 68 from the centerline 70 of assembly 30 and cavity 28. The diameter of offset hole 66 may be equal to or smaller than that of plug 74.

Pressure compensation assembly 30 includes spring 60, such as a Belleville spring, to seal assembly 30 and allow release of excess pressure within assembly 30. For example, Belleville spring 60 may have an operating pressure of about 60 to 80 p.s.i. Assembly 30 may include piston disk 54 positioned between diaphragm 32 and Belleville spring 60. Piston disk 54 increases the effective surface area of diaphragm 32, to increase its pressure relieving force which corresponds to an increase in sealing force. Bellevelle spring 60 and piston disk 54 include passageways 76 and 78, respectively.

Figure 3:
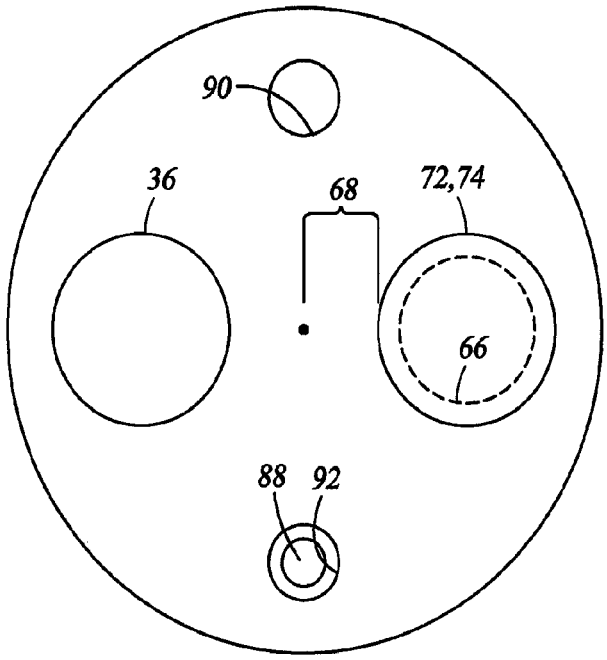
FIG. 3 is a cross-sectional view taken generally along the line 3-3 of FIG. 2 showing the pressure compensating apparatus in a fill position.

FIGS. 2 and 3 show pressure compensation assembly 30 in a "fill position". FIG. 3 is a cross-sectional view taken generally along the line 3-3 of FIG. 2. While assembly 30 is in the fill position, offset hole 66 of end cap 58 is positioned proximate to plug 74. In the fill position, assembly 30 may pull vacuum and allow lubricant to be pumped into assembly 30. Because offset hole 66 is positioned proximate to plug 74, a user may introduce lubricant into lubricant passageway 26 of drill bit 10 at a selected pressure exceeding the operating pressure of the relief mechanism, e.g., Belleville spring 60, without causing lubricant to leak into mud port 36. Once assembly 30 has been filled with lubricant, assembly 30 may be rotated within cavity 28 about centerline 70 to an "operating position", at which point plug 62 may be positioned into fill passageway 64 and snap ring 56 coupled to assembly 30 to capture it in the operating position.

Figure 5:
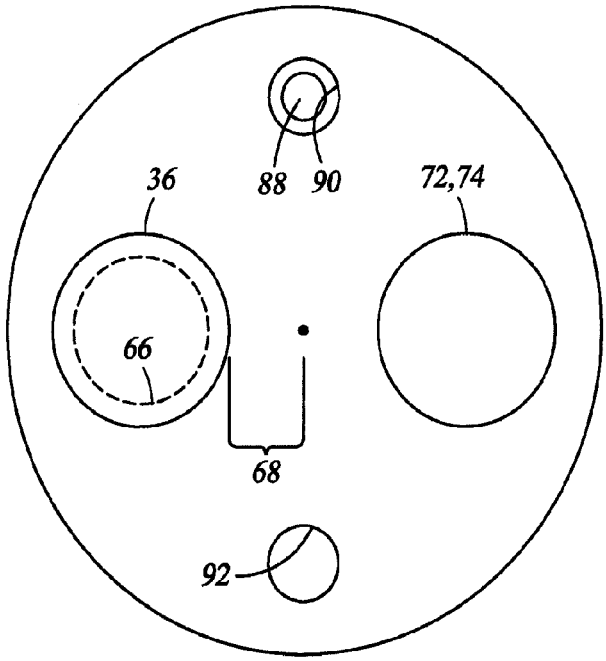
FIG. 5 is a cross-sectional view taken generally along the line 5-5 of FIG. 4 showing the pressure compensating apparatus in a operating position.
Figure 4:
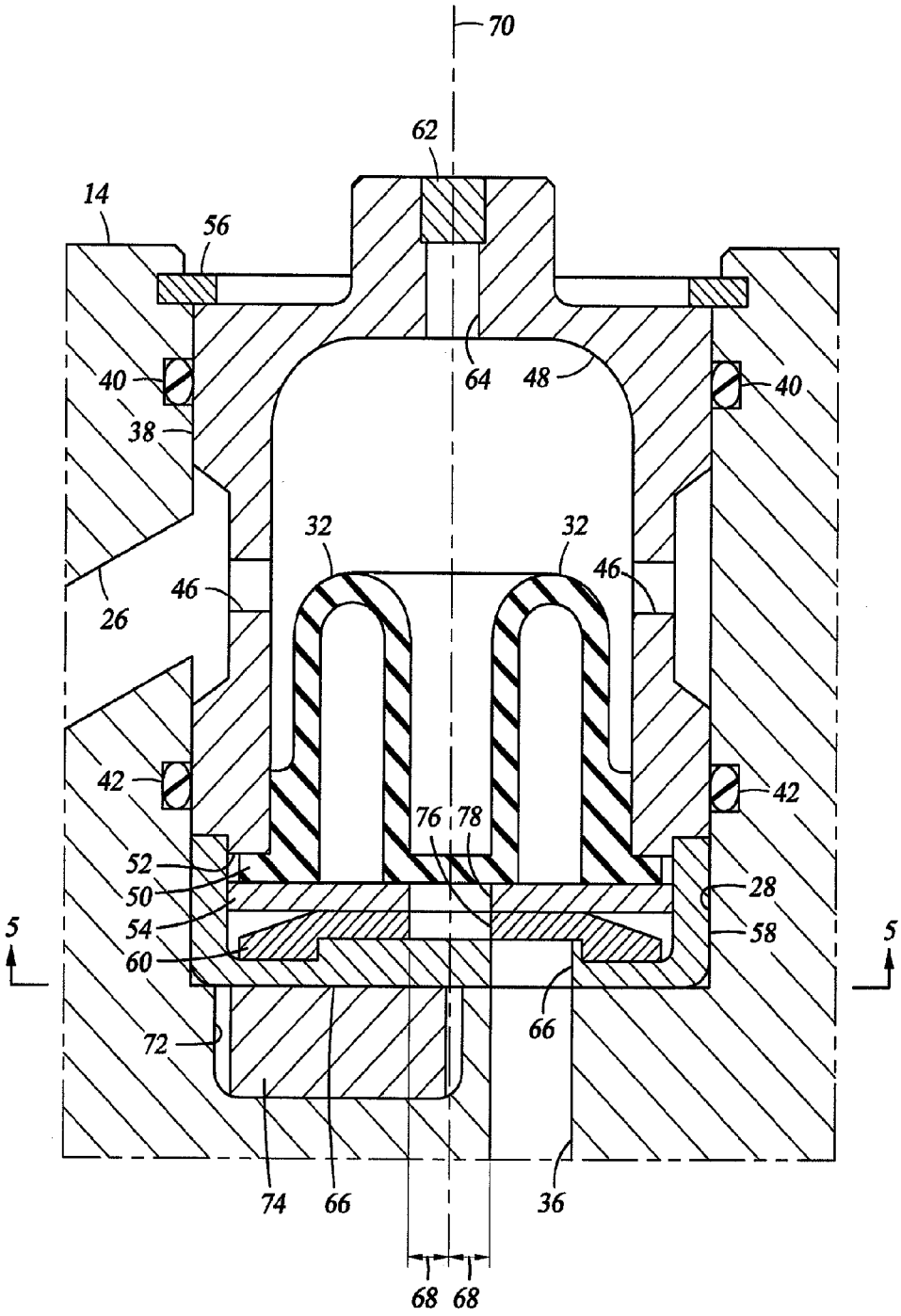
FIG. 4 is an enlarged partial cross-sectional view of a portion of FIG. 1, illustrating the pressure compensating apparatus in more detail in the operating position.

FIGS. 4 and 5 show pressure compensation assembly 30 in the operating position. FIG. 5 is a cross-sectional view taken generally along the line 5-5 of FIG. 4. While assembly 30 is in the operating position, offset hole 66 of end cap 58 is positioned proximate to mud port 36, providing a open channel between the two. In the operating position, assembly 30 may limit the pressure differential between the lubricant sealed within drill bit 10 and the well bore fluid.

As shown in FIGS. 3 and 5, pressure compensation assembly 30 may include a locking mechanism to selectively secure assembly 30 in the fill position or the operating position. Assembly 30 may include locking pin 88 positioned in end cap 58. Cavity 28 may include pin holes 90 and 92 to receive locking pin 88. As shown in FIG. 3, when assembly 30 is positioned into the fill position, a user may engage locking pin 88 to pin hole 92 to prevent assembly 30 from moving into the operating position. Once lubrication is completed, a user may disengage locking pin 88 from pin hole 92, position assembly 30 into the operating position shown in FIG. 5 and engage locking pin 88 to pin hole 90 to secure assembly 30 in the operating position.

Figure 6:
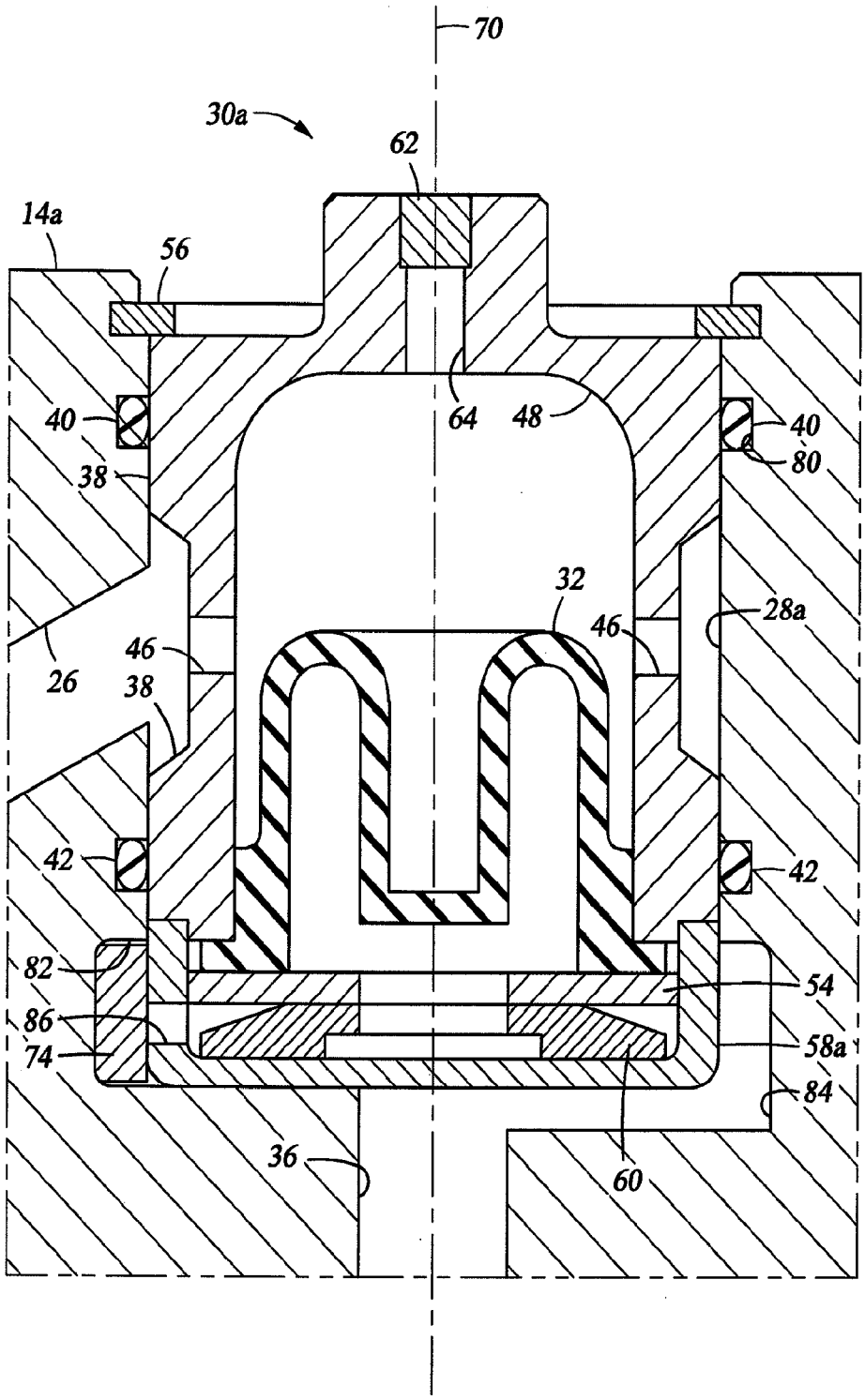
FIG. 6 is a partial cross-sectional view of another embodiment of the pressure compensating apparatus, illustrating the pressure compensating apparatus in the fill position.
Figure 7:
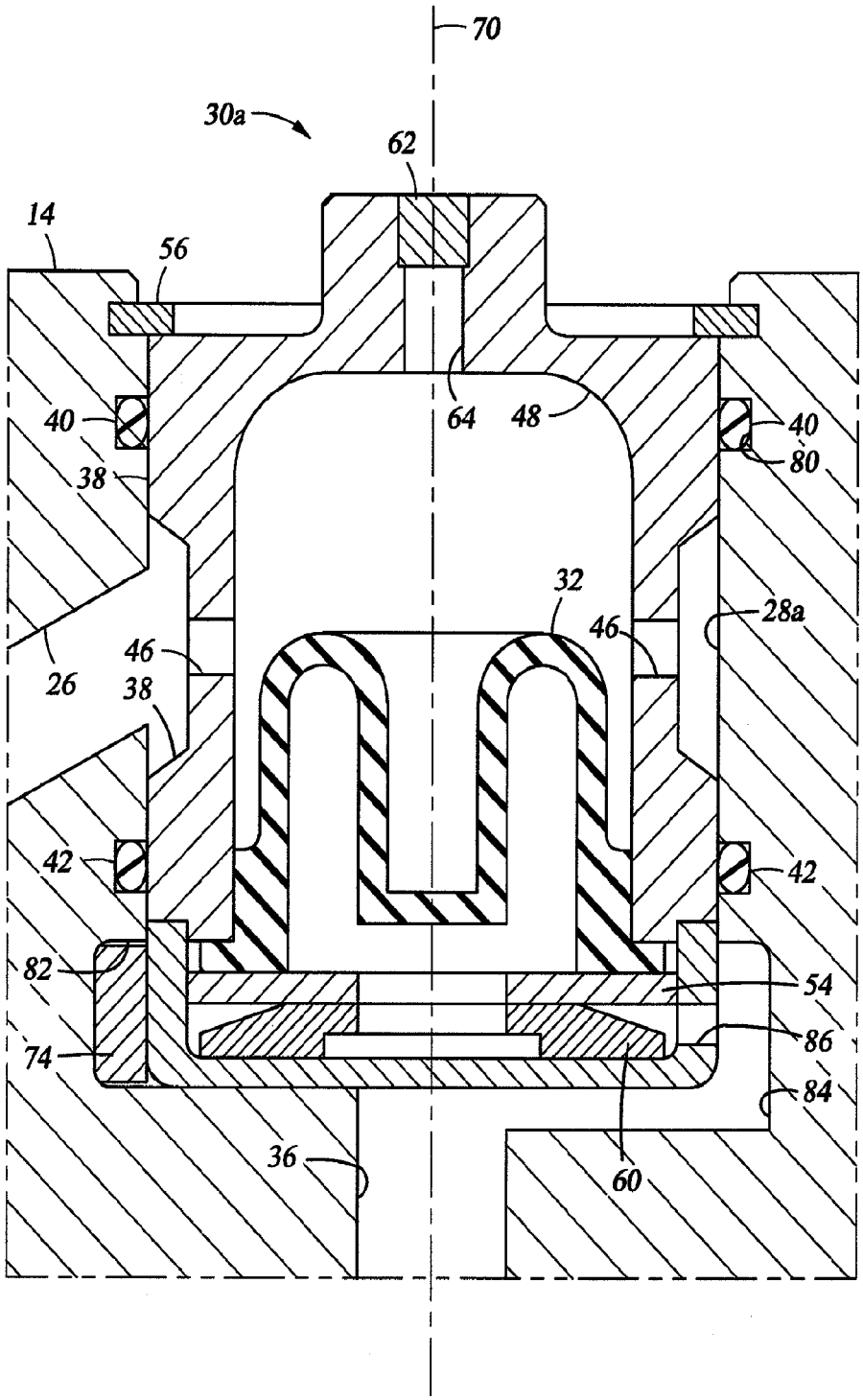
FIG. 7 is a partial cross-sectional view of the embodiment of FIG. 6, illustrating the pressure compensating apparatus in the operating position.

FIGS. 6 and 7 show another embodiment of pressure compensation assembly 30*a*. Arm 14*a* also includes side counterbore 82 positioned on a side wall of cavity 28 to allow plug 74 to be positioned therein. Arm 14*a* also includes side passageway 84 positioned on a side wall of cavity 28 and connected to mud port 36. End cap 58*a* of assembly 30*a* includes side end cap hole 86.

FIG. 6 shows assembly 30*a* in the fill position. When assembly 30*a* is in the fill position, side hole 86 of end cap 58*a* is positioned proximate to plug 74, which is positioned in side counterbore 82. Because side hole 86 is positioned proximate to plug 74, a user may introduce lubricant into drill bit 10 at a selected pressure exceeding the operating pressure of the relief mechanism. Once assembly 30*a* has been filled with lubricant, assembly 30*a* may be rotated within cavity 28*a* about centerline 70 to an operating position, at which point plug 62 may be positioned into fill passageway 64 and snap ring 56 coupled to assembly 30*a* to capture it in the operating position.

FIG. 7 shows assembly 30*a* in the operating position. While assembly 30*a* is in the operating position, side hole 86 of end cap 58*a* is positioned proximate to side passageway 84 which is connected to mud port 36, providing a open channel. In the operating position, assembly 30*a* may limit the pressure differential between the lubricant sealed within drill bit 10 and the well bore fluid.

From the foregoing detailed description of specific embodiments of the invention, it should be apparent that a pressure compensation assembly for a drill bit that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A pressure compensation assembly for a drill bit having a cavity to receive the pressure compensation assembly, a mud port coupled to the cavity, and a lubricant passageway coupled to the cavity, wherein the pressure compensation assembly comprises:

a relief mechanism having a selected operating pressure;

a channel providing a pathway from said pressure compensation assembly to said mud port, wherein said pressure compensation assembly provides a first position in which the channel is blocked by a plug and a second position in which the channel is not blocked by said plug, and said pressure compensation assembly is transitioned between the first and second positions without removing components of the pressure compensation assembly;

wherein the pressure compensation assembly is movable from said first position to said second position within the cavity;

wherein the pressure compensation assembly is operable to receive lubricant at a pressure exceeding the selected operating pressure to permit the flow of lubricant into the lubricant passageway while preventing the release of lubricant into the mud port while in the first position; and wherein the pressure compensation assembly is operable to limit a pressure differential within the drill bit while in the second position.

2. The pressure compensation assembly of claim 1, further comprising a body having a central axis;

a hollow interior formed within the body;

a diaphragm positioned within the hollow interior; and an end cap coupled to the bottom of the body, wherein said channel is provided by the end cap.

3. The pressure compensation assembly of claim 2, wherein the channel is positioned at the bottom of the end cap at a point offset from the central axis.

4. The pressure compensation assembly of claim 3, further comprising a piston disk.

5. The pressure compensation assembly of claim 4, wherein the relief mechanism comprises a spring.

6. A drill bit comprising:

a pressure compensation assembly, wherein the pressure compensation assembly comprises a relief mechanism having a selected operating pressure, wherein the pressure compensation assembly is operable to receive lubrication at a pressure exceeding the selected operating pressure while preventing the release of lubricant from the pressure compensation assembly; and a channel providing a pathway from said pressure compensation assembly to a mud port, wherein said pressure compensation assembly provides a first position in which the channel is blocked by a plug and a second position in which the channel is not blocked by said plug, and said pressure compensation assembly is transitioned between the first and second positions without removing components of the pressure compensation assembly.

7. The drill bit of claim 6, wherein the pressure compensation assembly is movable from the first position to the second position, wherein the pressure compensation assembly is operable to receive lubricant in the first position and operable to limit a pressure differential within the drill bit in the second position.

8. The drill bit of claim 7, wherein the pressure compensation assembly is rotatable within the drill bit between the first and second position.

9. The drill bit of claim 8, wherein the pressure compensation assembly further comprises :

a body;

a hollow interior formed within the body;

a diaphragm positioned within the hollow interior; and an end cap coupled to the bottom of the body, wherein said channel is provided by the end cap.

10. The drill bit of claim 9, wherein the drill bit further comprises:

a cavity to receive the pressure compensation assembly, wherein said plug is positioned proximate to the cavity;

a mud port coupled to the cavity; and a lubricant passageway coupled to the cavity.

11. The drill bit of claim 10, wherein the channel is proximate to the plug when the pressure compensation assembly is in the first position; and wherein the channel is proximate the mud port when the pressure compensation assembly is in the second position.

12. The drill bit of claim 11, wherein the plug is positioned at the bottom of the cavity.

13. The drill bit of claim 11, wherein the plug is positioned at a side wall of the cavity.

14. The drill bit of claim 11, wherein the plug comprises a rubber disk.

15. The drill bit of claim 11, wherein the relief mechanism comprises a spring.

16. The drill bit of claim 11, wherein the pressure compensation assembly comprises a piston disk.

17. The drill bit of claim 11, wherein the drill bit is a roller cone bit.

18. The drill bit of claim 11, further comprising a locking mechanism to selectively secure the pressure compensation assembly in the first position or the second position.

19. A method for lubricating a drill bit having a pressure compensation assembly comprising a relief mechanism having a selected operating pressure, comprising the steps of:

positioning the pressure compensation assembly in a first position, wherein a channel provided by said pressure compensation assembly is blocked by a plug in said first position;

providing lubricant to the drill bit at a selected pressure greater than the selected operating pressure, wherein the pressure compensation assembly prevents lubricant from leaking from the pressure compensation assembly during the step of providing lubricant while in the first position; and moving the pressure compensation assembly to a second position without removing components of the pressure compensation assembly when the drill bit has received a selected amount of lubricant, wherein the channel is not blocked by said plug in the second position.

20. The method of claim 19, wherein the pressure compensation assembly is operable to limit a pressure differential within the drill bit while in the second position.

21. The method of claim 20, wherein the step of moving the pressure compensation assembly to a second position further comprises the step of rotating the pressure compensation assembly.

* * * * *

UNITED STATES PATENT AND TRADEMARK OFFICE

CERTIFICATE OF CORRECTION

PATENT NO. : 8,579,046 B2
APPLICATION NO. : 12/740390
DATED : November 12, 2013
INVENTOR(S) : Crawford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 583 days.

Signed and Sealed this
Twenty-second Day of September, 2015

Michelle K. Lee

Michelle K. Lee
*Director of the United States Patent and Trademark Office*